US005353209A

United States Patent [19]

Foottit

[11] Patent Number: 5,353,209

[45] Date of Patent: Oct. 4, 1994

[54] ELECTRICAL DISTRIBUTION AND/OR LIGHTING SYSTEM WITH CONTINUOUS CONNECTION POINT

[76] Inventor: Roberto Foottit, 61 bis, rue des Peupliers, 92100 Boulogne, France

[21] Appl. No.: 925,109

[22] Filed: Aug. 6, 1992

[30] Foreign Application Priority Data

Aug. 9, 1991 [FR] France ..... 91 10196
Aug. 9, 1991 [FR] France ..... 91 10197

[51] Int. Cl.[5] ..... H01R 33/06

[52] U.S. Cl. ..... 362/226; 362/147; 362/427

[58] Field of Search ..... 362/147, 226, 287, 418, 362/427, 428, 289; 439/425, 426, 110, 113, 116

[56] References Cited

U.S. PATENT DOCUMENTS

| | | | |
|---|---|---|---|
| 3,489,981 | 1/1970 | Corl | 439/425 |
| 3,748,629 | 7/1973 | Price | 439/116 |
| 3,757,086 | 9/1973 | Indoe | 439/426 |
| 3,801,951 | 4/1974 | Kemmerer et al. | 439/116 |
| 4,029,378 | 6/1977 | Bolis | 439/116 |
| 4,313,645 | 2/1982 | Cocco | 439/460 |
| 4,314,737 | 2/1982 | Bogese | 439/425 |
| 4,319,314 | 3/1982 | Morton | 362/147 |
| 4,600,975 | 7/1986 | Roberts | 362/147 |

*Primary Examiner*—Ira S. Lazarus

*Assistant Examiner*—Y. Quach

*Attorney, Agent, or Firm*—Staas & Halsey

[57] ABSTRACT

An electrical distribution system is provided with an elongated supporting channel which is U-shaped, an electric conductor which rests on the bottom of the elongated supporting channel, and a movable connecting supporting mechanism. The electric conductor has an insulating material and two electric cores embedded within the insulating material. The electric cores extend parallel to one another. Each electric core is formed from two distinct adjacent conductive elements which are electrically interconnected. The movable connecting and supporting mechanism includes a seat engagable with the elongated supporting channel. The seat has a first face with at least two electric conductive prongs projecting therefrom. Each prong has a perforating free end adapted to perforate the insulating material so that the prong can fit between the two conductive elements. The movable connecting and supporting means has an electrical connector connected to the seat. An electrical connecting mechanism electrically connects the prongs with the electrical connector. The movable connecting and supporting mechanism may also have a locking mechanism to lock the seat at a particular position in the supporting channel by engaging with a notch in the U-shaped channel.

10 Claims, 5 Drawing Sheets

ELECTRICAL DISTRIBUTION AND/OR LIGHTING SYSTEM WITH CONTINUOUS CONNECTION POINT

FIELD OF THE INVENTION

The subject of the present invention is an electrical distribution and/or lighting system with continuous connection point.

More particularly, the invention relates to a lighting and or electricity distribution system comprising a fixed electrical supply part and at least one movable lighting or connection means which can be connected at any point of the electrical supply set.

BACKGROUND OF THE INVENTION

A number of systems of this type are already known in which the fixed electrical supply means are comprised of an insulated cable with multiple conductors which is permanently fixed and the movable lighting means are comprised of a connector provided with two conductive prongs which are capable of perforating the insulator and enter into electrical contact respectively with each of the cores of the electrical supply cable. It is understood that the connection head can thus be connected to the cable at any convenient point. However, it appears that an installation of this type is ill-suited to connecting certain movable lighting means such as picture rails to light pictures or lighting tubes which have to be positioned, for instance, in an object display window and which have to be held firmly in place.

Another disadvantage of certain of these installations is that penetration by the ends of the prongs in the shape of pins in the cores of the electrical conductors can entail severing of one of the cores and thus make the installation unusable.

SUMMARY OF THE INVENTION

To solve these disadvantages, one aim of the present invention is to provide an electrical distribution and/or lighting system with continuous connection point which not only enables connection of the lighting means at any suitable point but also suitable fitting thereof to the electrical supply means.

To achieve this aim, the system, according to a first aspect of the invention, is characterized in that it comprises electrical supply means comprising a channel which can be fastened to a wall and an electrical conductor arranged in the said channel alongth its length, the said conductor comprising two conductive cores encased in an insulating material which can be perforated, and a movable connection and or lighting means comprising a seat, the said seat comprising means for positioning relative to said channel and means for temporary locking of said seat to said channel, and two electrical conductive prongs able to perforate said insulation, said prongs being positioned on said seat so as to come into contact with said cores when said seat is locked to the channel, a light source and/or connection means, and electrical conductors for electrically connecting said prongs to said light source and/or said connection means.

It is therefore understood that not only does the electrical supply fixed part enable electrical connection at any point of the cable by perforating the insulation sleeve by means of the prongs of the seat, but also mechanical fixture of the movable lighting and/or connection means to the channel associated with the electric cable.

According to a second aspect of the invention, the system is characterized in that it comprises an electrical conductive set comprising, encased in an insulating material, two conductive cores arranged so as to be parallel to one another, each core being comprised of two distinct adjacent elements and a movable connection and/or lighting set comprising a seat and two conductive prongs positioned on the seat such that each prong can pierce said insulating material and that its end is housed between said adjacent conductive elements, via which electrical contact is established between the end of each prong and the corresponding core, a connection and/or lighting means and conductors.

It is understood that, thanks to the particular configuration of each of the two cores which are comprised of two adjacent electrical conductive sets, the pins of the prongs do not pass through the conductive elements forming the cores but are inserted between said two conductive elements thereby providing electrical contact without the risk of disrupting electrical continuity thereof.

According to a preferred embodiment, each distinct conductive element forming a core is comprised of a single rigid electrical conductor. It is understood that the mechanical connection between the connector set and the electrical cable will thus be improved due to the rigidity of both adjacent conductive elements forming the same core, the end of the prongs being squeezed between the two rigid electrical conductive elements.

BRIEF DESCRIPTION OF THE DRAWINGS

Other features and advantages of the present invention will become more apparent when reading the following description of several embodiments of the invention given by way of non-limiting examples. The description refers to the attached drawings, in which.

DETAILED DESCRIPTION OF THE PREFERRED EMBODIMENTS

Figure 1:
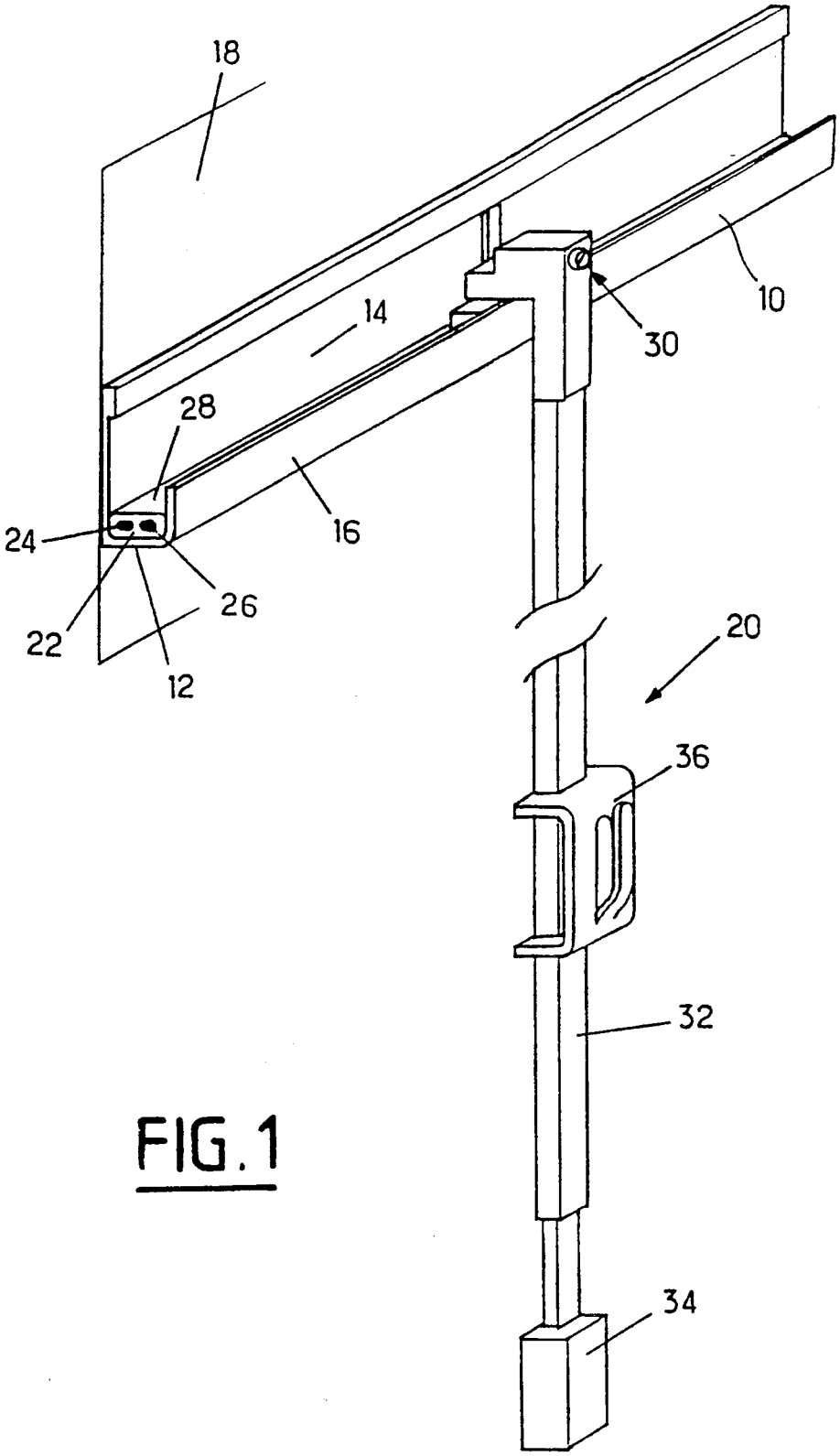
FIG. 1 is a perspective view of a first embodiment of the invention to create a picture rail with electrical supply to light pictures.
Figure 2:
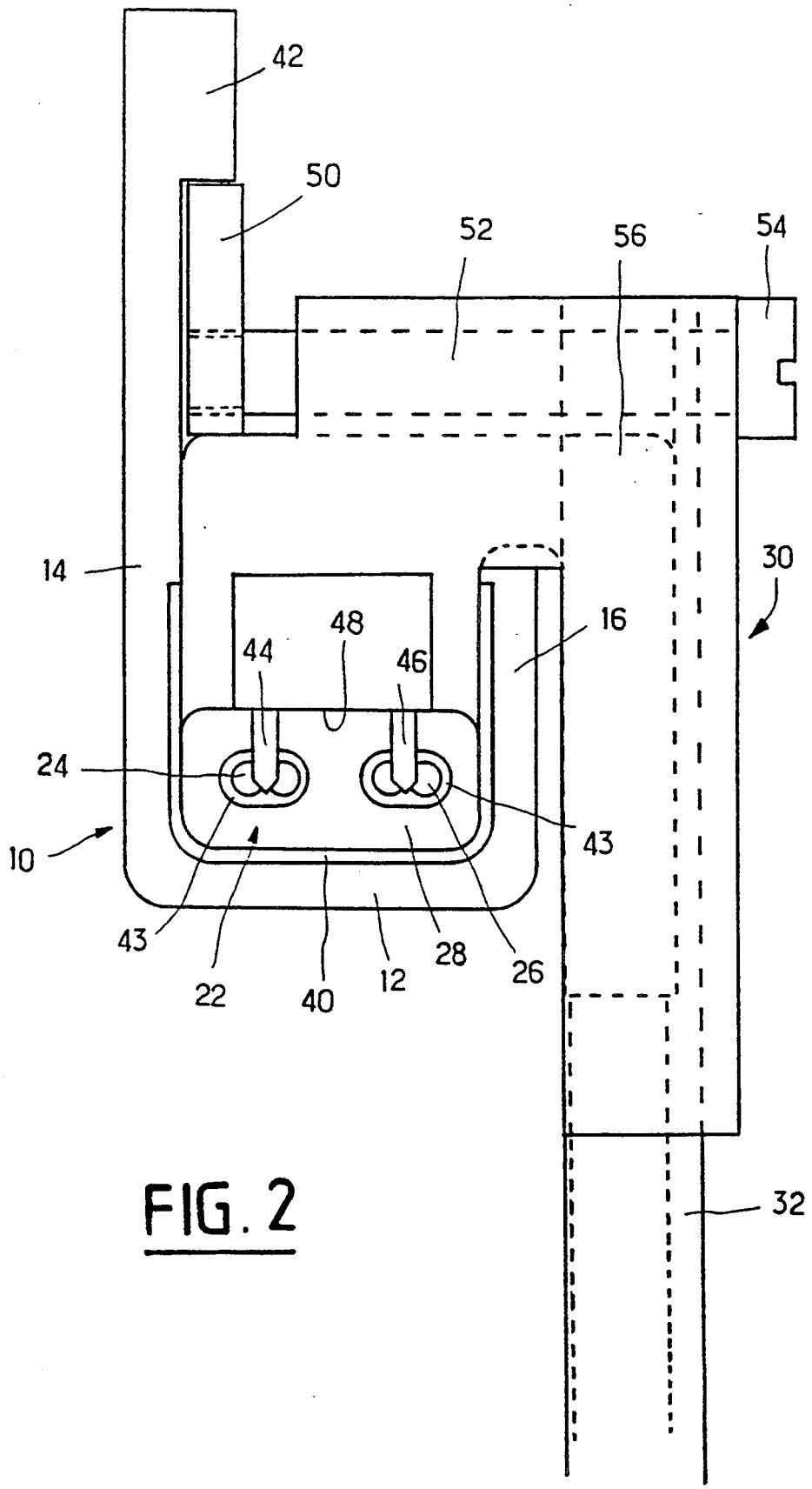
FIG. 2 is a partial view of the installation of FIG. 1 showing the seat for connecting the movable connection means.

Referring firstly to FIGS. 1 and 2, a first embodiment of the invention will be described enabling an electrical picture rail to be set up in an exhibition room. The installation firstly comprises an electrical supply which is comprised, on the one hand, of a channel 10 U-shaped in cross-section. The channel comprises a bottom 12, a first lateral wall 14, designed to be fixed to a partition 18 such as wall, and a second lateral wall 16, designed more particularly to clamp the movable lighting means which have the general reference 20 in FIG. 1. Inside the channel 10 and resting on its bottom 12, an electric cable 22 comprising two cores 24 and 26 encased in perforable insulating material 28. In this embodiment, the movable lighting means 20 comprise an electrical connection and fitting seat 30 which will be described in greater detail with reference to FIG. 2, a substantially vertical rod 32 forming a suspension post which ends in an electrical connection block 34 on which any suitable light source can be mounted, for instance a picture lighting tube. As is shown in FIG. 1, clamping means 36 for an object, such as a picture, are fixed to the vertical rod 32 and their position can be adjusted as required. The channel 10 with its cable 22 can be fixed in an aesthetic manner to the walls of a room by giving the channel 10 an agreeable aspect. The channel 10 can run at a convenient height close to the ceiling along all the walls of the room, for instance a painting exhibition room.

Referring now to FIG. 2, the embodiment of the channel and the seat 30 of the movable lighting means will now be described in greater detail. As FIG. 2 shows more clearly, the bottom 12, the free wall 16 and the lower part of the fixture wall 14 of the channel are covered with an insulating material 40 so as to further improve the electrical safety of the installation. Said Figure also shows that the upper end of the lateral wall 14 comprises a projecting edge 42 turned towards the second lateral wall 16. Further, the lateral wall 14 has a height substantially greater than the lateral wall 16, which, in this particular embodiment, gives the channel 10 a J-shape rather than a U-shape. In this embodiment, it will also be seen that the cores 24 and 26 are each surrounded by an insulating material 43 which is in turn encased in the sheath 28.

The seat 30 comprises a connection part which includes two tapered conductive prongs 44 and 46 which project in the lower face of the connection head 48. The connection head 48 has a suitable width for penetrating inside the channel 10 between its lateral walls 14 and 16. The prongs 44 and 46 are positioned in such a way that, when the connection head 48 is engaged in the channel, the prongs penetrate the insulating sheath 28 and come into electrical contact with the conductive cores 24 and 26 of the cable 22. The seat 30 also comprises a device for locking to the channel 10. Said locking device comprises a retaining clip 50 rigid with the end of a shaft 52 which passes through the seat 30 in a pivoting manner. The second end of the shaft 52 comprises an actuating head 54. The pivoting retaining clip has a length such that, when the actuating head is acted upon in the appropriate direction, the retaining clip 50 comes to abut the edge 42 of the wall 14 of the channel. Locking and immobilisation of the seat 30 on the channel 10, and thus the electric cable, are obtained in this way. It is also understood that acting on the actuating head 54 causes the prongs 44 and 46 to penetrate the insulating material of the electric cable, thus providing the electrical connection.

The seat 30 also comprises a part forming a crosshead 56 which overlaps the free edge of the lateral wall 16 of the channel. The crosshead 56 is fast with the upper end of the rod 32. Naturally, inside the rod 32 and the seat 30 there are electrical conductors, not shown, connected to the connection head 48, said electrical conductors being in turn connected via their second end to the electrical connector 34.

It is understood that an installation is thus obtained which enables connection of an electric light source at any point whatsoever of the electric cable 22 and that, further, said light source can be fixed mechanically to the channel 10 supporting the cable, which enables a great variety of installation types.

Figure 3:
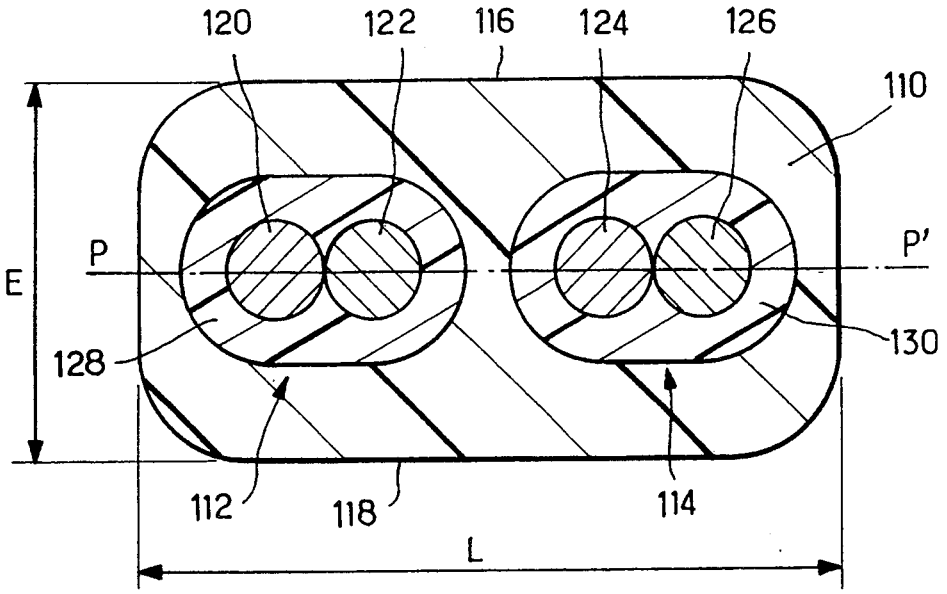
FIG. 3 is a cross-section of an electrical cable usable in the system according to the invention.
Figure 4:
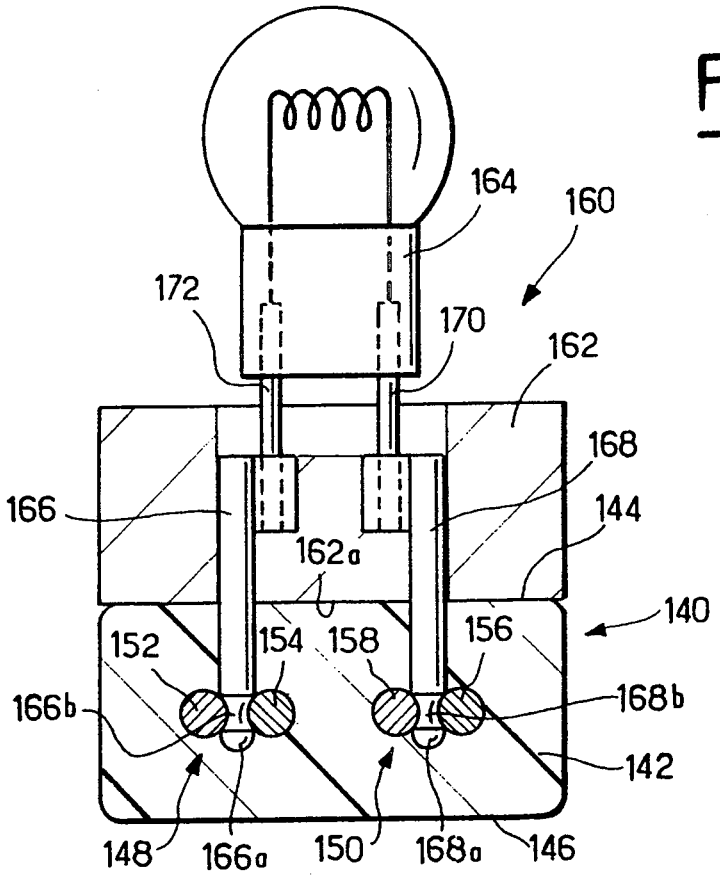
FIG. 4 shows an example for mounting a connector set onto the cable of FIG. 3.

It is obvious that the installation which has just been described could comprise an electric cable of the type shown in FIG. 3 and the conductive prongs of the connection head could comprise the recesses shown in FIG. 4.

Referring now to FIG. 3, a perfected electric cable structure forming part of the system according to the invention will be described. The electric cable is comprised of an insulating sheath 110 inside which two conductive cores 112 and 114 are encased. As FIG. 3 shows, preferably, the cable in cross-section comprises two flat faces 116 and 118 substantially parallel to one another, said faces being parallel to the plane PP' of the cable containing cores 112 and 114. According to the invention, each core, respectively 112 and 114, is comprised of two distinct conductive elements with the references 120 and 122 for the core 112 and 124 and 126 for the core 114. According to the embodiment shown in FIG. 3, each conductive element 120 and 126 comprises a single conductive strand or rigid wire with a circular section, the two conductive elements forming the same core being tangents. Further, according to a preferred embodiment, the set of two conductive elements forming the same core, 120, 122; 124, 126 respectively, is surrounded by an insulating envelope, with the respective references 128 for core 112 and 130 for core 114.

According to the particular example of the embodiment shown in FIG. 3, width L of the insulating sheath is equal to 9.4 mm, thickness E of the insulating sheath is also 4.5 mm, the thickness of individual sheaths 128 and 130 is in the order of 0.6 mm and the diameter of each of the conductive elements 120 to 126 is in the order of 1.3 mm. It is understood that, if the outer insulating envelope 110 and the individual envelopes 128 and 130 of the cores of the prongs which are sharp to ensure the electrical connection, are penetrated, the ends of the prongs tend to deflect the conductive elements forming the same core, which enables proper electrical connection. Further, and moreover, said electrical contact is established without perforating the conductive element, which prevents any risk of severing thereof.

Referring now to FIG. 4, an example of connection to the cable of FIG. 3 of an electric bulb will now be described. The conductive cable 140 comprises an outer insulating sheath 142 comprising two flat external faces 144 and 146. The conductor 140 comprises two cores 148 and 150 respectively comprising conductive elements 152, 154 and 156, 158. In this embodiment, the cores are not surrounded by any particular insulating sheath. The element to be connected, which has the reference 160, comprises a seat 162 on which an electric bulb 164 is mounted. Two conductive prongs 166 and 168 project outside the lower face **162*a* of the seat 162. Said prongs are electrically connected via conductors 170 and 172 to the bulb 164. According to this embodiment, it can be seen that each prong comprises a sharp end 166*a* and 168*a* and, in the proximity of said end, a recess 166*b* and 168*b*. The recesses 166*b* and 168*b* are positioned on the prongs in such a way that, when the face 162*a*** of the seat is in contact with the upper face 144 of the cable 140, said recesses are arranged between the rigid conductors 152, 154 and 156, 158. A locking effect of the prongs 166 and 168 is thereby obtained between the rigid conductive elements comprising the two cores which, under the effect of the inuslating sheath 142, tend to move closer together under the effect of the material comprising the insulating sheath.

It will be seen that, thanks to the particular arrangements of this embodiment of the invention, the mechanical link between the connector element and the electrical cable is further improved, which obviates the need for specific means for fixing the connector element to the cable element.

Figure 5:
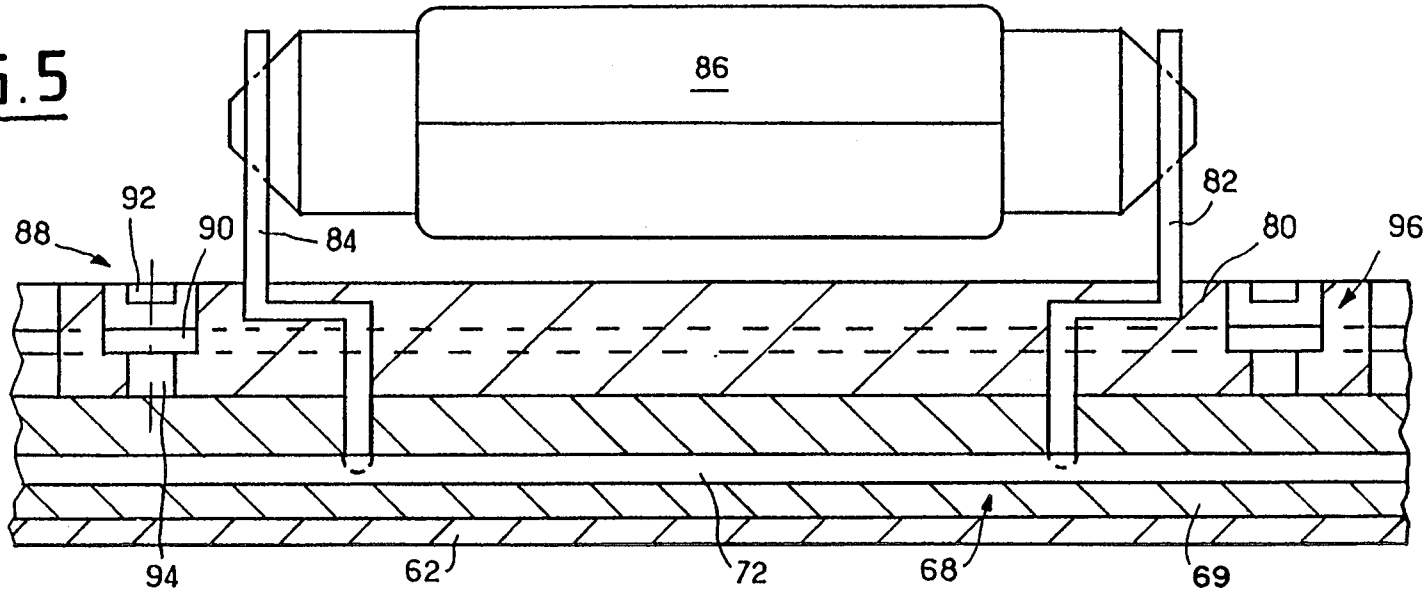
FIG. 5 is an elevation view of a second embodiment of the invention wherein the movable lighting means is of the tube type.
Figure 6:
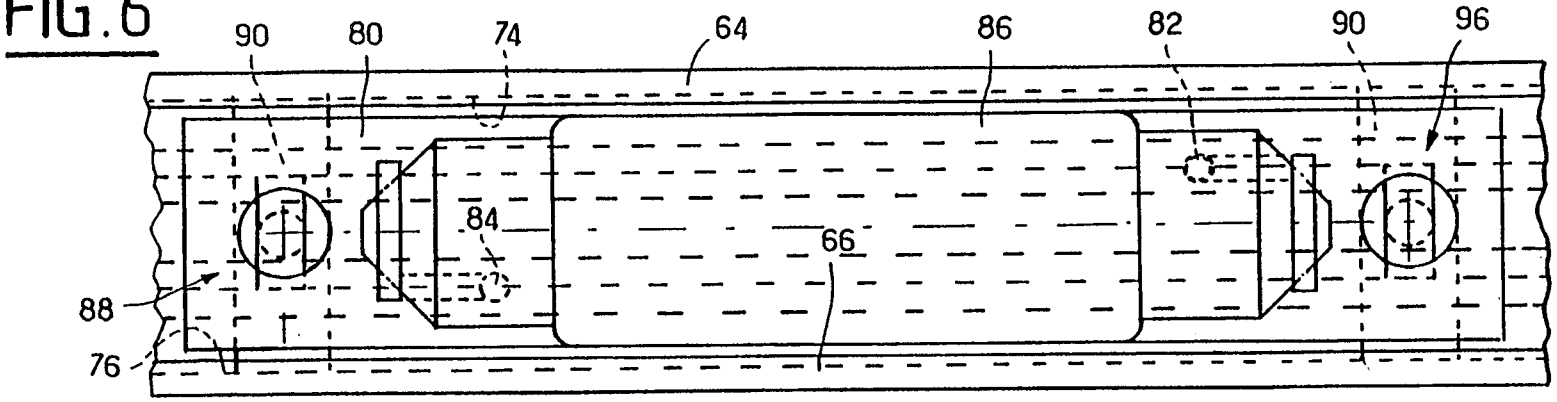
FIG. 6 is a plan view of the lighting installation according to FIG. 5.
Figure 7:
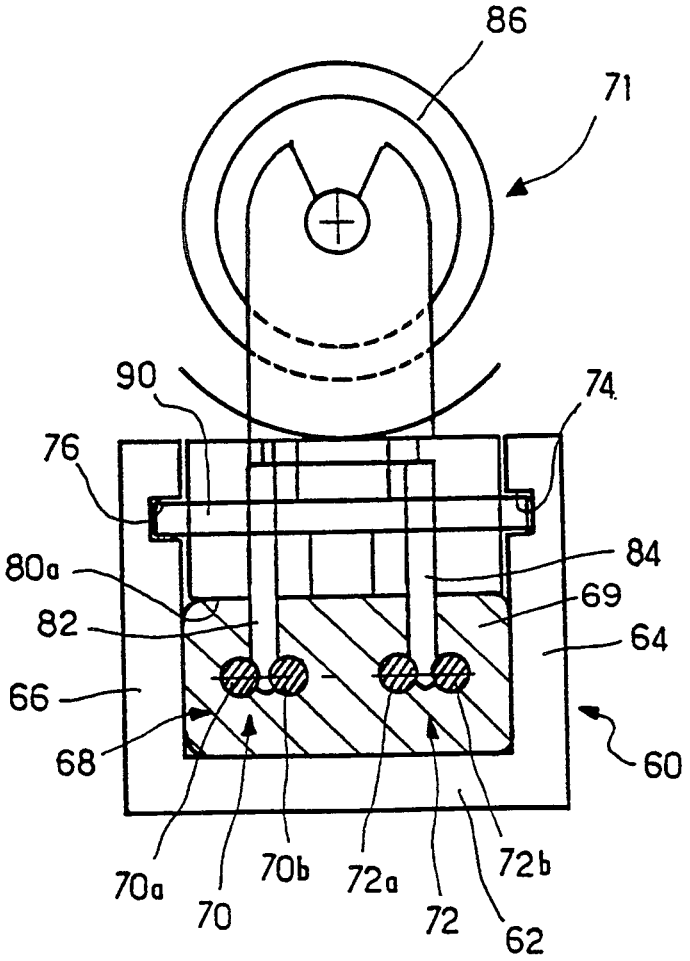
FIG. 7 is a side view of the lighting installation of FIGS. 5 and 6.

Referring now to FIGS. 5 to 7, a second embodiment of the invention will be described in which the movable light source is of the tube-type.

The electrical supply part is comprised of a channel 60 comprising a bottom 62 and two lateral walls 64 and 66. On the bottom 62 of the channel an electric cable 68 is mounted comprised of two cores 70 and 72, each core being in turn formed by two multi-strand electric conductors 70*a*, 70*b* and 72*a*, 72*b*. The insulating material 69 of the cable is shaped so as to occupy the full width of the channel bottom. Further, the lateral walls 64 and 66 are provided, in the proximity of their upper ends, with a longitudinal groove with the respective references 74 and 76.

The light source 71 is comprised of a seat 80 formed so as to be able to be supported on the upper face of the cable 68 by being housed in the remaining inner part of the channel 60. In said seat two electrical conductive prongs 82 and 84 project which are also used for mounting the tube-shape light source 56. In the proximity of its two ends, the seat 80 comprises two systems for locking said seat to the channel 60. Preferably, the locking system 88 is comprised of a pivoting retaining clip 90 which, as shown in FIG. 7, penetrates the recesses 74 and 76 when said retaining clip is in the locked position, i.e. perpendicular to the length of the channel 60. The locking operation can be performed by a pivoting part 92 appearing in the upper face of the seat 80 and fast with the retaining clip 90 via a pivoting shaft 94. The second locking system 96 has exactly the same structure. Mounting the light source clearly follows on from the above description. The seat is placed in the channel 60 at the chosen point, the retaining clips 90 of the locking systems being in the recessed position. By exerting sufficient pressure, the conductive prongs 82 and 84 pass through the insulation 69 of the cable and come into electrical contact with the upper face of the cable 68. In said position, by acting on the actuating heads, the retaining clips 90 are brought into their locking position by pivoting. In this way, not only is the light source connected in the desired place, but said source is made rigid with the electrical supply means very simply.

Obviously, the electrical cable in fact comprises at least two conductive cores. The scope of the invention would not be exceeded if the cable had three cores for triphase power.

Further, in the described examples, the element connected and fastened to the channel provided with its cable was a light source. It is obvious that said element could be an electrical connector such as a power plug or a connection box.

I claim:

1. An electrical distribution system with a variable connection point, comprising:

an elongated supporting channel having a U-shaped cross section defining first and second branches and a bottom, the first and second branches being substantially vertical when the channel is substantially horizontal, said first branch being longer than the second branch and being adapted for fastening with a wall, said second branch having a free edge;

an electric conductor arranged in said channel along the length thereof and lying on the bottom of said channel, said electric conductor including a perforable insulating material and at least two conductive cores encased within said insulating material; and movable connecting and supporting means comprising:

a seat engagable with said channel between said channel branches, said seat having a first face adapted to face said electric conductor when engaged in said channel, said seat being provided with at least two electrically conductive prongs projecting from said first face, each prong having a perforating free end adapted to perforate the insulating material of the electric conductor;

an electrical connector mechanically connected to said seat;

electrical connecting means for connecting said electrical connector and said prongs; and locking means connected to said seat and including a manually operable locking member movable between a first position wherein said seat can be readily engaged within said channel and a second position wherein said locking member is applied against said channel, to provide mechanical locking of said seat within said channel and to cause said prongs to perforate the insulating material, whereby an electrical contact is established between said prongs and the cores of the electric conductor.

2. The electrical distribution system of claim 1, wherein said electrical connecting means includes a rod which is substantially vertical when said seat is engaged in said channel and said channel is substantially horizontal, said seat being connected with a first end of said rod, said electrical distribution system further comprising a light source connected to and stationary with the electrical.

3. The electrical distribution system of claim 2, further comprising clamping means for supporting an object, said clamping means being attached to said rod.

4. The electrical distribution system of claim 1, wherein each conductive core is comprised of two distinct adjacent conductive elements adapted to receive an end of one prong, the prong being inserted between the two conductive elements forming the core, the prong being received when said seat is locked to said channel.

5. An electrical distribution system with a variable connection point comprising:

an elongated supporting channel for extending horizontally, the channel having U-shaped cross section defining first and second substantially vertical branches and bottom;

an electric conductor arranged in said channel along a length thereof and resting on the bottom of said channel, said electric conductor comprising:

a perforable insulating material; and at least two electrical cores embedded within said insulating material and extending substantially parallel one with the other, each electrical core comprising two distinct conductive elements adjacent to each other and electrically interconnected; and movable connecting and supporting means comprising:

a seat engagable with said channel, said seat having a first face adapted to face said electric conductor, said seat being provided with at least two electrically conductive prongs projecting from said first face, each prong having a perforating free end adapted to perforate said insulating material and to be inserted between the distinct conductive elements forming the electrical core to establish an electrical contact between said prong and said two distinct conductive elements of the electrical core;

an electrical connector mechanically connected to said seat; and electrical connecting means for connecting said prongs with said electrical connector.

6. The electrical distribution system of claim 5, wherein each conductive element is comprised of a single rigid electrical conductor.

7. The electrical distribution system of claim 6, wherein each pairs of distinct conductive elements forming one core are surrounded by an insulating sheath.

8. The electrical distribution system of claim 5, wherein each conductive element is comprised of a plurality of conductive strands.

9. The electrical distribution system of claim 5, wherein each prong comprises a sharp end for piercing said insulating material and a reduced diameter portion adapted to be housed between the two distinct conductive elements.

10. An electrical distribution system with a variable connection point, comprising:

an elongated supporting channel having a U-shaped cross section defining first and second branches and a bottom, the first and second branches being substantially vertical when the channel is substantially horizontal, said first branch being longer than the second branch, being adapted for fastening with a wall and having a projecting rim, said second branch having a free edge;

an electric conductor arranged in said channel along the length thereof and lying on the bottom of said channel, said electric conductor including a perforable insulating material and at least two conductive cores encased within said insulating material; and movable connecting and supporting means comprising:

a seat engagable with said channel between said channel branches, said seat having a first face adapted to face said electric conductor when engaged in said channel, said seat being provided with at least two electrically conductive prongs projecting from said first face, each prong having a perforating free end adapted to perforate the insulating material of the electric conductor;

an electrical connector mechanically connected to said seat;

electrical connecting means for connecting said electrical connector and said prongs; and locking means connected to said seat and including a manually operable locking member movable between a first position wherein said seat can be freely engaged within said channel and a second position to apply said locking means against said channel, to provide mechanical locking of said seat within said channel and to perforate the insulating material by said prongs whereby an electrical contact is established between said prongs and the cores of the electric conductor, said locking means comprising:

a retaining clip;

a shaft mounted so as to pivot in said seat, said shaft having a first end to which the retaining clip is attached and a second end which forms an actuating head, said shaft and retaining clip functioning as the movable locking member with the retaining clip cooperating with the rim when the movable locking member is in the second position.

* * * * *